US005094090A

United States Patent [19]

Bone

[11] Patent Number: 5,094,090

[45] Date of Patent: Mar. 10, 1992

[54] JEWELRY FRAME WITH DANGLE ADORNMENT

[76] Inventor: Theresa A. Bone, 1155 Fielder Creek Rd., Rogue River, Oreg. 97537

[21] Appl. No.: 540,088

[22] Filed: Jun. 19, 1990

[51] Int. Cl.[5] ..... A44C 1/00

[52] U.S. Cl. ..... 63/20; 63/29.1

[58] Field of Search ..... 24/706.4, 49 K, 49 R, 24/49 P; 63/20–23, 29.1, 2, 12, 13

[56] References Cited

U.S. PATENT DOCUMENTS

| | | | |
|---|---|---|---|
| 613,029 | 10/1898 | Fair | 63/20 |
| 758,848 | 5/1904 | Pejchar | 63/12 |
| 1,441,924 | 12/1920 | Hartmann . | |
| 2,118,639 | 5/1938 | Bayardi | 63/20 |
| 2,180,726 | 5/1939 | Bradley . | |
| 2,274,269 | 2/1942 | Jellinek | 63/20 X |
| 3,348,388 | 10/1965 | Elliott . | |
| 3,456,457 | 10/1965 | Cass . | |
| 3,605,438 | 9/1971 | Chalson | 63/12 X |
| 4,507,344 | 3/1985 | Baughman . | |
| 4,741,179 | 5/1988 | McConnell, Jr. | 63/13 |
| 4,803,852 | 2/1989 | Waldron | 63/13 |

FOREIGN PATENT DOCUMENTS

| | | | |
|---|---|---|---|
| 331182 | 1/1921 | Fed. Rep. of Germany | 63/20 |
| 54006 | 11/1911 | Switzerland | 24/706.4 |

*Primary Examiner*—James R. Brittain

*Attorney, Agent, or Firm*—Knobbe Martens Olson & Bear

[57] ABSTRACT

A clothing pin-type accessory is provided defining an artistic frame of a predetermined shape and design and equipped with rearwardly directed mounting shank portions for penetrating through a layer of thick clothing material and a pair of clutches are removably mountable from the free ends of the mounting shanks for releasably securing the pin to the clothing material. A dangle-type adornment is provided and mounting eye means is further provided and loosely engaged over at least one of the mounting shanks for supporting the adornment in dangle fashion from the frame. In a preferred embodiment of the invention, the frame is generally planar, includes a closed periphery and the dangle-type adornment is suspended in generally centered position within the frame.

15 Claims, 1 Drawing Sheet

JEWELRY FRAME WITH DANGLE ADORNMENT

BACKGROUND OF THE INVENTION

1. Field of the Invention

This invention relates to clothing accessories. More particularly, this invention relates to a jewelry frame with means for attaching many different types of dangling adornments.

2. Description of Related Art

Several different types of decorative devices adapted to selectively attach a variety of small adornments are know to one skilled in the art. U.S. Pat. No. 1,441,924 to Hartmann discloses supporting frames and structures for beading which may be used in conjunction with necklaces and other similar devices. A disadvantage of this device is that it is limited to the display of beads and does not permit the attachment of other numerous types of jewelry adornments. Furthermore, the device only attaches to necklaces and the like which are put on and taken off by a person repeatedly. The device does not remain attached to clothing so that it may remain on a given article of clothing as long as desired.

U.S. Pat. No. 2,180,726 to Bradley discloses clips attached to jewelry items. The clips have hinged jaws which can grip a desired article to be attached to a jewelry item. The clips, however, are bulky and designed for gripping flowers. The clips are not suited for the attachment of small jewelry adornments.

U.S. Pat. No. 3,348,388 to Elliot discloses a bracelet having means to interchangeably receive various brooches having pins attached. This device is not able to be worn on clothing. Also, the device is limited to receiving only those adornments having pins attached to them.

U.S. Pat. No. 4,507,344 to Baughman discloses a pin having a detachable face. A disadvantage of this device is that only adornments specifically adapted to fit within the face of the pin may be selectively attached to the pin. This severely limits the number and style of adornments which may be selectively worn with the device.

SUMMARY OF THE INVENTION

The present invention comprises an artistic frame of a predetermined shape and design. In the preferred embodiment of the present invention, the invention comprises a generally planar frame having a closed periphery and inner and outer margins. The frame includes front and rear sides and a pair of peripherally spaced mounting shanks project rearwardly from the frame. The shanks include forward ends anchored relative to the frame and rearward outermost ends adapted to penetrate thick clothing material, as well as an intermediate length portions between the forward and rearward ends. The intermediate length portions of the shanks each are of a length greater than necessary to extend through the aforementioned thick clothing material and abutment-type clutches are removably mountable on the rearward ends of the shanks.

One or both of the mounting shanks includes a dangle-type adornment, including mounting eye means loosely receivable on the corresponding shank intermediate length portion adjacent the corresponding forward end and the mounting eye means is of sufficient length (multiple interconnected eye members) to support the adornment laterally inwardly, or laterally outwardly, of the inner or outer margin of the frame.

In the instance of a heart shape frame, at least one of the mounting shanks thereof will be disposed at the upper central portion of the heart shape frame and the adornment supported therefrom in dangle-fashion will be reasonably centered within the heart shape frame.

The main object of this invention is to provide a clothing accessory pin from which various different types of dangle adornments may be supported.

Another object of this invention is to provide a clothing accessory pin from which various different types of dangle adornments may be removably supported.

Still another object of this invention is to provide a dangle adornment equipped clothing accessory pin from which various different dangle-type adornments may be selectively supported.

Still another object of this invention is to provide a clothing accessory pin supporting various dangle adornments which can be attached to virtually any form of clothing.

Still another object of this invention is to provide a clothing accessory pin which can be secured tightly enough to an article of clothing such that there will be no extra room for bagging of the clothing.

Still another object of this invention is to provide a clothing accessory pin which can be secured to an article of clothing to prevent the possibility of the frame inadvertently falling off of the article of clothing and the adornments from becoming lost.

Still another object of this invention is to provide a clothing accessory pin which can support one or more dangle adornments.

A final object of this invention to be specifically enumerated herein is to provide a clothing accessory pin for supporting dangle-type adornments therefrom and which will conform to conventional forms of manufacture, be of simple construction and easy to use so as to provide a device that will be economically feasible, long-lasting and relatively trouble free in installation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
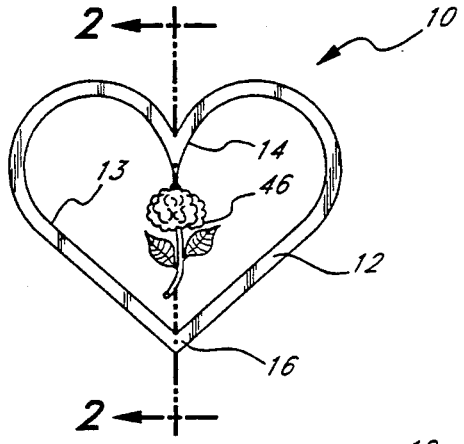
FIG. 1 is an elevational view of a jewelry frame and dangle adornment assembly constructed in accordance with the present invention.

Referring now more specifically to the drawings the numeral 10 generally designates a jewelry frame and dangle adornment combination constructed in accordance with the present invention. The combination 10 includes a peripherally continuous, substantially planar frame 12 constructed in the shape of a heart and including upper and lower central portions 14 and 16. However, it should be understood that frames of many shapes and sizes can be constructed in accordance with and embody the principles of the present invention.

The frame 12 includes front and rear sides 18 and 20 as well as projections or mounting shanks 22 and 24 supported from and extending rearwardly of the portions 14 and 16.

The shanks include forward ends 26 and 28 anchored relative to the portions 14 and 16, rearward outermost ends 30, 32 adapted to penetrate thick clothing material 34 and intermediate length portions 36 and 38 between the forward ends 26, 28 and the rearward ends 30, 32. The intermediate length portions are of a length greater than necessary to extend through the thick clothing material 34 and the mounting shanks 22 and 24 have their rearward ends 30 and 32 forced through the clothing material 34. In addition, abutment type clutches 40 and 42 are removably secured on the mounting shanks 22 and 24 on the side of the clothing material 34 remote from the frame 12 to thereby secure the frame 12 to the clothing material 34.

The mounting shanks 22 and 24 are externally threaded and the clutches 40 and 42 are similarly internally threaded. However, other types of mounting shanks and clutches may be used, if desired. In the preferred embodiment, the mounting shanks 22 and 24 and the clutches 40 and 42 are made from white gold. White gold is preferred because it is stronger than 14K gold and does not break down or strip as easily as 14K gold.

The combination 10 additionally includes a dangle-type adornment 46 and mounting eye means 48 is provided for supporting the adornment 46 from the mounting shank 22.

The mounting eye means includes a first planar closed eye 50 loosely disposed on the intermediate length portion 36 of the mounting shank 22, a second closed planar eye 52 loosely engaged with the lower portion of the eye 50 and disposed in a plane positioned at generally right angles relative to the plane of the eye 50 and the plane of the frame 12 and a third eye 54 through which the eye or loop 52 is loosely received, the eye 54 being formed integral with the adornment 46.

Because of the overall effective length of the mounting eye means 48 comprising the eyes, 50, 52 and 54 and the positioning of the mounting shank 22 at the upper central portion 14 of the frame 12, the adornment 46 is suspended within the interior perimeter of the frame 12, substantially centered in the heart shape frame.

The eye 50 is of larger internal cross-sectional area than the eye 52 or the eye 54, thereby enabling the eye 50 to be more readily engaged over the mounting shank 22 prior to the frame 12 being secured to the thick clothing material 34.

Figure 2:
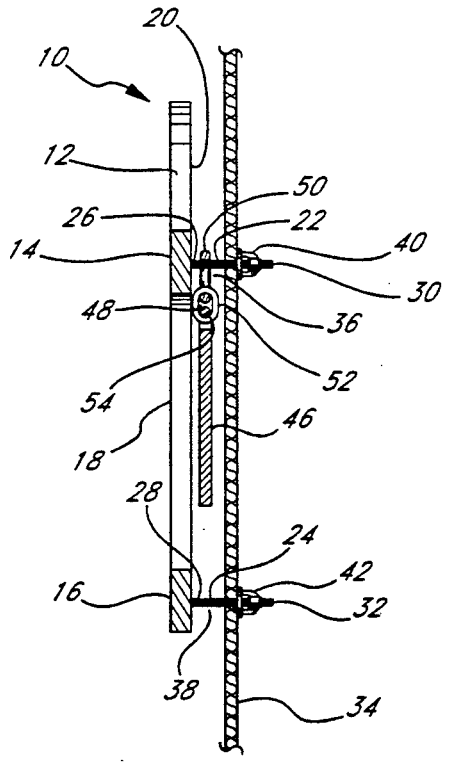
FIG. 2 is an enlarged vertical sectional view taken substantially upon the plane indicated by the section line 2—2 of FIG. 1.

The screw threads on the mounting shanks 22 and 24 allow for the frame 10 to be tightened against the clothing 34 sufficiently so that there is no room between the back of the frame 20 and the clothing 34 for bagging of the clothing. The elimination of bagging also eliminates the feeling of heavy hanging jewelry that tears one's clothing. The ability of the present invention to avoid bagging and tearing one's clothing is further enhanced by the open-frame configuration of the frame 12, and similar frames. In other words, the frame consists only of an outline or periphery with no metal on the interior surface, thus greatly reducing the weight of the frame. On the other hand, the length and width of the frame give it an attractive appearance and a pleasing background for the adornments attached thereto. Adding to the attractiveness of the frame is the substance and width of its peripheral outline; although, it can still be made thin (as shown in FIG. 2) so as to minimize weight. Finally, since the frame has a double shank configuration, wherein the shanks 22 and 24 are spaced apart, additional support for the article as worn on the clothing is provided. In other words, two areas of the wearer's clothing share the weight of the article, rather than just one area, thus distributing such weight over a larger surface area. Preferably, the center of gravity of the frame will lie intermediate the two shanks.

The screw threads also serve the purpose of reliably securing the frame and adornment to the clothing. The threads prevent the clutches 40 and 42 from accidentally disengaging from the mounting shanks 22 and 24, causing the possible loss of the frame 10 and adornment 46, which is a more likely occurrence with other attachment means.

Figure 3:
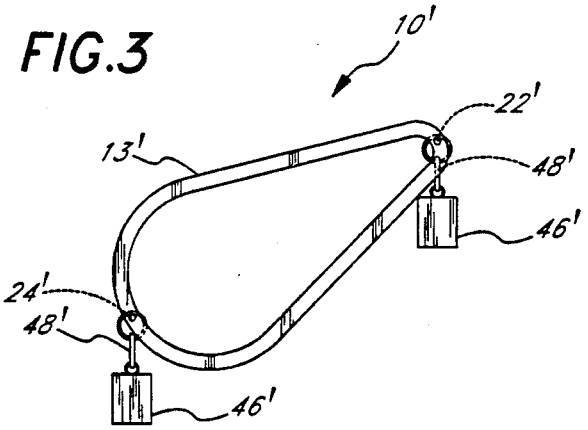
FIG. 3 is an elevational view of an alternative embodiment of the invention incorporating a jewelry frame of a different shape.

An alternative embodiment of the clothing accessory frame and adornment combination is illustrated FIG. 3 and generally referred to by the reference numeral 10'. The combination 10' includes a generally oval frame 12' tapering in with toward one end and the opposite ends of the frame 12' include mounting shanks 22' and 24' corresponding to the mounting shanks 22 and 24 and adornments 46' loosely supported therefrom in dangle fashion through the utilization of mounting eye means 48' corresponding to the mounting eye means 48. In the case of the frame 12', the adornments 46' are suspended therefrom in positions disposed at least substantially entirely outwardly of the outer periphery 13' of the frame 12', whereas the adornment 46 is suspended entirely within the inner periphery 13 of the frame 12, that embodiment of the invention illustrated in FIG. 1 and 2 being the preferred embodiment of the invention.

In embodiments having more than one adornment attached to the frame, the distance between the shanks should be far enough that when an adornment is attached to each shank, the dangling adornments do not overlap each other.

It is readily apparent that the frame may be worn with adornments on all shanks, on only one or a few shanks, or without any adornments at all. This versatility allows for many combinations of looks with one artistic frame.

It is important to note that the intermediate length portions 36 and 38 of the mounting shanks 22 and 24 are of sufficient length not only to extend through the thick clothing material 34, but also to loosely receive the eye 50 on the intermediate length portion 36 between the thick clothing material 34 and the frame 12. Not only must the eye 50 be loosely received on the intermediate portion 36, but there must be sufficient space between the frame 12 and the thick clothing material 34 in which to loosely receive the eye 52.

By providing the frame 12 and its mounting shanks 22 and 24 as well as the clutches 40 and 42 as disclosed and by providing the mounting eye means 48, any suitable adornment 46 may be used in conjunction with the frame 12. Thus, a person's pin and adornment jewelry collection may be more versatilely used. The adornments can be changed whenever desired, or a favorite adornment may remain on a certain article of clothing as long as desired.

It is apparent that the simple and versatile method of mounting the frame allows the frame to be mounted on virtually any article of clothing. Illustrative examples of clothing articles to which the frame may be attached are hats, scarfs, belts, ties, lapels, and the like.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A clothing accessory for displaying charms, jewelry, adornments, and the like, on one's clothing comprising:

a frame of a predetermined shape which is pleasing and decorative when worn on one's clothing, said frame having an open central area in order to minimize the weight of said frame;

a front face and a rear face on said frame, said front face also being decorative and enhancing the wearer's clothing;

plural projections projecting from said rear face of said frame for receiving a charm, jewelry, or adornment, and for penetrating the clothing of the wearer for mounting said frame on said clothing, said plural projections distributing the weight of said frame over more surface area, thereby preventing the bagging and tearing of the clothing of the wearer;

adaptor means for engaging said charm, jewelry, or adornment, from each one of said plural projections, said adapter means being mountable on at least one of said plural projections; and securing means engaging said plural projections for simultaneously securing said adapter means on said at least one of said plural projections at a position intermediate said frame and said securing means and for securing said frame to one's clothing so as to not allow said frame to sag or tear the clothing of the wearer.

2. The clothing accessory of claim 1, wherein said frame is generally planar.

3. The clothing accessory of claim 1, wherein said securing means tightly and securely engages said adaptor means and a layer of one's clothing to the rear face of said frame to prevent bagging and tearing of clothing.

4. The clothing accessory of claim 3, wherein said securing means is internally threaded and said plural projections are externally threaded such that said securing means can be tightly and securely mounted on said plural projections.

5. The clothing accessory of claim 1, wherein said adapter means comprises mounting eye means including a first closed eye loosely disposed on said projection and a second closed eye loosely suspended from said first eye, said second eye passing loosely through a third eye formed integrally with said charm, jewelry, or adornment.

6. The clothing accessory of claim 1, wherein said sad charm, jewelry, or adornment, which is suspended from one of said plural projections is suspended and dangles within said central area.

7. The clothing accessory of claim 1, wherein said charm, jewelry, or adornment, is suspended laterally outside of said central area of said frame.

8. The clothing accessory of claim 1, wherein said frame further comprises a non-closed loop configuration.

9. The clothing accessory of claim 1, wherein said frame further comprises a closed loop configuration.

10. The clothing accessory of claim 1, wherein the center of gravity of said frame is approximately intermediate said plural projections so that said projections share the weight of said frame, thereby preventing the sagging and tearing of the wearer's clothing.

11. A clothing accessory for displaying charms and the like from one's clothing, said charms having an integral eye and a loop formed therein for suspending said charms from a secondary item of jewelry, said clothing accessory providing an attractive display for such charms on the clothing of the wearer, comprising:

a frame having a closed loop configuration and an open central area with a relatively thin cross section in order to minimize the weight of said frame, said frame further comprising an inner edge and an outer edge which defines the width of said frame, said width having a front and rear face;

a pair of mounting shanks comprising a proximal end, a distal end and an intermediate section, said proximal end being rigidly mounted on said rear face of said frame so that said mounting shanks project away from said frame, said distal end of said shanks extending a sufficient length so as to penetrate the thick clothing of the wearer, said mounting shanks being peripherally spaced on said frame;

an adapter for receiving said closed eye of said charm, said adapter also engaging the intermediate section of said mounting shank to permit said charm to be suspended therefrom;

a charm suspended from said adapter; and threaded abutment members which are threadably received by the distal ends of said pair of shanks for securely mounting said charm on said shanks and for securely fastening said frame to said clothing of the wearer to prevent sagging or tearing thereof.

12. The clothing accessory of claim 11, wherein said mounting shanks are spaced sufficiently apart so as to distribute the weight of the frame over a wider surface area of said frame whereby the sagging or bagging of the wearer's clothing is prevented.

13. A clothing accessory, comprising:

a first adornment of a predetermined shape and design;

at least two mounting shanks attached to said first adornment, each said mounting shank having an end and adapted to penetrate clothing, said mounting shanks being spaced sufficiently apart so as to distribute the weight of said frame over a wide-surface area of said frame;

an abutment member removably mountable on the end of each said shank, said abutment member being detachable from said frame for selectively attaching a secondary adornment to said first adornment; and an adapter for engaging said secondary adornment, said adapter being removably securable intermediate said first adornment and said abutment member on said shank.

14. A clothing accessory as defined by claim 13, wherein said mounting shank has an externally threaded portion, said externally threaded portion mating with an internally threaded portion of said abutment member.

15. A clothing accessory as defined by claim 13, further comprising mounting means having a closed eye surrounding said mounting shank.

* * * * *